US007195527B2

(12) United States Patent
Tani et al.

(10) Patent No.: US 7,195,527 B2
(45) Date of Patent: Mar. 27, 2007

(54) OPERATIONAL CONTROL DEVICE FOR JET PROPULSION WATERCRAFT

(75) Inventors: Satoshi Tani, Shizuoka (JP); Kenji Itou, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/728,063

(22) Filed: Dec. 4, 2003

(65) Prior Publication Data

US 2004/0144293 A1 Jul. 29, 2004

(30) Foreign Application Priority Data

Dec. 4, 2002 (JP) ..... 2002-352656

(51) Int. Cl.
*B63H 21/21* (2006.01)

(52) U.S. Cl. ..... 440/87; 440/42

(58) Field of Classification Search ..... 440/1, 440/38, 40, 41, 42, 84, 87
See application file for complete search history.

(56) References Cited

U.S. PATENT DOCUMENTS 3,146,632 A * 9/1964 Irgens ..... 477/113
3,899,993 A * 8/1975 Powers ..... 440/84
4,026,235 A * 5/1977 Woodfill ..... 440/41
4,556,005 A 12/1985 Jackson
4,582,493 A 4/1986 Toyohara et al.
4,693,689 A 9/1987 Harada
4,949,662 A 8/1990 Kobayashi
4,961,396 A 10/1990 Sasagawa
4,971,584 A 11/1990 Inoue et al.
4,972,792 A 11/1990 Yokoyama et al.
4,989,533 A 2/1991 Horiuchi
5,094,182 A 3/1992 Simner
5,113,777 A 5/1992 Kobayashi
5,167,547 A 12/1992 Kobayashi et al.
5,244,425 A 9/1993 Tasaki et al.
5,350,325 A 9/1994 Nanami
5,367,970 A 11/1994 Beauchamp et al.

(Continued)

FOREIGN PATENT DOCUMENTS

CA 2271332 2/2000

(Continued)

OTHER PUBLICATIONS

*Jet Sports*, vol. 15, No. 8, Aug. 1996, Advertisement for Trim Adjuster.

(Continued)

*Primary Examiner*—Sherman Basinger
(74) *Attorney, Agent, or Firm*—Knobbe, Martens, Olson & Bear, LLP

(57) ABSTRACT

A jet propulsion unit for a small watercraft includes a reverse thrust arrangement. The reverse thrust arrangement includes a water diverter bucket assembly moveable between an open position and a closed position with respect to a steering nozzle of the jet propulsion unit. An idle speed of the watercraft's engine can be manually and/or automatically adjusted between a low engine idle speed and a high engine idle speed. The lower engine idle speed allows comfortable shifting maneuvers. The higher engine idle speed provides for tighter turning when the throttle is released. The engine cannot be started unless the reverse trust arrangement is in a partially open position.

12 Claims, 7 Drawing Sheets

U.S. PATENT DOCUMENTS

| | | | | |
|---|---|---|---|---|
| 5,429,533 | A | | 7/1995 | Kobayashi et al. |
| 5,474,007 | A | | 12/1995 | Kobayashi |
| 5,494,464 | A | * | 2/1996 | Kobayashi et al. ..... 440/41 |
| 5,520,133 | A | | 5/1996 | Wiegert |
| 5,582,125 | A | | 12/1996 | Matsumoto |
| 5,591,057 | A | | 1/1997 | Dai et al. |
| 5,603,644 | A | | 2/1997 | Kobayashi et al. |
| 5,697,317 | A | | 12/1997 | Pereira |
| 5,707,264 | A | | 1/1998 | Kobayashi et al. |
| 5,713,297 | A | | 2/1998 | Tani et al. |
| 5,839,700 | A | | 11/1998 | Nedderman, Jr. |
| 5,908,006 | A | | 6/1999 | Ibata |
| 6,014,954 | A | * | 1/2000 | Kleeman et al. ..... 123/339.13 |
| 6,032,605 | A | | 3/2000 | Takashima |
| 6,038,995 | A | | 3/2000 | Karafiath et al. |
| 6,062,154 | A | | 5/2000 | Ito |
| 6,077,136 | A | | 6/2000 | Arai et al. |
| 6,086,437 | A | | 7/2000 | Murray |
| 6,138,601 | A | | 10/2000 | Anderson et al. |
| 6,159,059 | A | | 12/2000 | Bernier et al. |
| 6,171,159 | B1 | | 1/2001 | Shen et al. |
| 6,174,210 | B1 | | 1/2001 | Spade et al. |
| 6,178,907 | B1 | | 1/2001 | Shirah et al. |
| 6,202,584 | B1 | | 3/2001 | Madachi et al. |
| 6,213,044 | B1 | | 4/2001 | Rodgers et al. |
| 6,216,624 | B1 | | 4/2001 | Page |
| 6,227,919 | B1 | | 5/2001 | Blanchard |
| 6,244,914 | B1 | | 6/2001 | Freitag et al. |
| 6,305,307 | B1 | | 10/2001 | Yokoya |
| 6,314,900 | B1 | | 11/2001 | Samuelsen |
| 6,332,816 | B1 | | 12/2001 | Tsuchiya et al. |
| 6,336,834 | B1 | | 1/2002 | Nedderman, Jr. et al. |
| 6,386,930 | B2 | | 5/2002 | Moffet |
| 6,415,729 | B1 | | 7/2002 | Nedderman, Jr. et al. |
| 6,428,372 | B1 | | 8/2002 | Belt |
| 6,443,785 | B1 | | 9/2002 | Swartz et al. |
| 6,478,638 | B2 | | 11/2002 | Matsuda et al. |
| 6,523,489 | B2 | | 2/2003 | Simard et al. |
| 6,530,812 | B2 | | 3/2003 | Koyano et al. |
| 6,551,153 | B1 | | 4/2003 | Hattori |
| 6,695,657 | B2 | | 2/2004 | Hattori |
| 6,709,302 | B2 | | 3/2004 | Yanagihara |
| 6,722,932 | B2 | | 4/2004 | Yanagihara |
| 2001/0036777 | A1 | | 11/2001 | Iida et al. |
| 2003/0075094 | A1 | | 4/2003 | Aoyama |
| 2004/0067700 | A1 | | 4/2004 | Kinoshita et al. |

FOREIGN PATENT DOCUMENTS

| | | |
|---|---|---|
| JP | 60-029396 | 2/1985 |
| JP | 62-129539 | 6/1987 |
| JP | 01-212624 | 8/1989 |
| JP | 01-212625 | 8/1989 |
| JP | 06-144375 | 5/1994 |
| JP | 08-002489 | 1/1996 |
| JP | 09-252606 | 9/1997 |
| JP | 10-053195 | 2/1998 |
| JP | 2001-329881 | 11/2001 |
| JP | 2002-264876 | 9/2002 |
| JP | 2002-317673 | 10/2002 |
| JP | 2003-063494 | 3/2003 |
| WO | WO 00/40462 | 7/2000 |

OTHER PUBLICATIONS

*Jet Sports*, vol. 16, No. 8, Aug. 1997, Advertisement for trim adjuster.

*Personal Watercraft Illustrated*, Aug. 1998, Advertisement for trim adjusters for Sea-doo watercraft.

Copending U.S. Appl. No. 10/624,111, filed Jul. 21, 2003, entitled: Control for Watercraft Propulsion System, in the name of Yoshimasa Kinoshita and assigned to Yamaha Marine Kabushiki Kaisha.

Copending U.S. Appl. No. 10/659,424, filed Sep. 10, 2003, entitled Watercraft Steering Assist System, in the names of Yutaka Mizuno, Ryoichi Nakase and Tsuide Yanagihara and assigned to Yamaha Hatsudoki Kabushiki Kaisha.

Copending U.S. Appl. No.10/774,863, filed Feb. 9, 2004, entitled Engine Control For Watercraft, in the name of Tsuide Yanagihara and assigned to Yamaha Hatsudoki Kabushiki Kaisha.

* cited by examiner

OPERATIONAL CONTROL DEVICE FOR JET PROPULSION WATERCRAFT

PRIORITY INFORMATION

The present application is based upon, and claims priority to Japanese Patent Application No. 2002-352656, filed Dec. 4, 2002, the entire contents of which is hereby expressly incorporated by reference.

BACKGROUND OF THE INVENTION

1. Field of the Invention

The present invention relates to an operation control device for a watercraft.

2. Description of the Related Art

Personal watercraft have become very popular in recent years. This type of watercraft is quite sporting in nature and carries a rider and possibly one or more passengers. A relatively small hull of the watercraft commonly defines a rider's area above an engine compartment. An internal combustion engine is used to power a jet propulsion unit that propels the watercraft. A throttle valve in the current engine controls the amount of air that enters the engine and therefore determines the amount engine torque requested by the operator. The engine lies within the engine compartment in front of a tunnel formed on the underside of the watercraft hull. The jet propulsion unit is located within the tunnel and is driven by an output shaft of the engine. An impeller shaft coupled to the jet propulsion unit extends forward, through a wall of the hull tunnel, and is coupled to the engine output shaft. In this manner, the engine drives the jet propulsion unit.

The jet propulsion unit conventionally includes an impeller housing in which an impeller is contained. The impeller, which is driven by the engine through the impeller shaft, draws water through a water inlet and forces it through a discharge nozzle to propel the watercraft. A steering nozzle is mounted on the discharge nozzle for pivotal movement about a vertical axis. Pivotal movement of the steering nozzle about the vertical steering axis alters a discharge direction of the water jet to steer the watercraft.

Many personal watercraft also include a water reverse thrust deflector or "reverse bucket" for redirecting the jet generally forwardly, thereby producing a reverse thrust. The reverse thrust deflector is usually supported about the end of the jet propulsion unit to move pivot between a raised position, in which the deflector does not affect the water jet issuing from the steering nozzle, and a fully lowered position, in which the deflector cooperates with the steering nozzle and redirects water issuing from the jet propulsion unit forwardly to achieve the reverse thrust.

The position of the reverse thrust deflector is usually controlled through an actuator accessible by the operator of the watercraft. A control arrangement couples the reverse thrust deflector for movement with the actuator. Common control arrangements include a mechanical cable, or bowden-wire, or an electronic arrangement.

SUMMARY OF THE INVENTION

In accordance with one aspect of the invention, a watercraft comprises a hull and an engine supported by the hull. The engine drives a jet propulsion unit and the jet propulsion unit comprises a steering nozzle configured to direct a jet of water exiting the jet propulsion unit. A water diverter bucket is disposed near the steering nozzle and is movable between an opened position, a partially opened position, and a closed position at which the water diverter bucket at least partially redirects the jet of water. A control assembly is coupled to the water diverter bucket to move the water diverter bucket between the opened, partially opened, and closed positions. The control assembly includes an actuator, an operation cable and a switch. The cable has a first end and a second end, the first end being coupled to the actuator and the second end being coupled to the water diverter bucket such that movement of the actuator moves the first end of the operation cable. Movement of the first end of the operation cable in turn moves the second end of the operation cable, thereby moving the water diverter bucket assembly toward one of the opened, partially opened, and closed positions. The switch of the control assembly is arranged to detect whether the water diverter bucket is in the partially opened position and communicates with the engine such that the engine is allowed to start only when the water diverter bucket is in the partially opened position.

In accordance with a further aspect of the invention, the steering nozzle of the watercraft defines at least two effluent openings. The water diverter bucket is arranged to close one of the effluent openings when in the closed position.

In accordance with another aspect of the invention, a watercraft comprises a hull and an engine. The engine is supported by the hull and includes at least one throttle. A jet propulsion unit is driven by the engine. The jet propulsion unit comprises a steering nozzle configured to direct a jet of water exiting the jet propulsion unit. A throttle actuator mechanism is coupled with the throttle, and a control lever cooperates with the throttle actuator mechanism. The control lever is selectively positional in at least a first or a second position. The first position of the control lever is arranged such that the throttle actuator mechanism rests in a first position and the second position of the control lever is arranged such that the throttle actuator mechanism rests in a second position. The throttle has a first position when the throttle actuator mechanism rests in its first position and has a second position when the throttle actuator mechanism rests in the second position. The second throttle position provides a larger opening degree than the first throttle position.

A further aspect of the invention includes a method of controlling an engine speed of a marine engine that powers a propulsion unit of a watercraft. The method comprises selecting between a first throttle resting position and a second throttle resting position depending upon a desired operational mode of the watercraft. The second throttle resting position causes the engine to power the propulsion unit by an amount sufficient to assist steering of the watercraft when decelerating from at least a planing speed.

Yet another aspect of the invention includes a method of controlling an engine of a watercraft. The watercraft includes a jet propulsion unit and a water diverter bucket disposed behind the jet propulsion unit. The method comprises determining whether the diverter bucket lies in a neutral position and prevents the engine from being started if the diverter bucket is not in the neutral position.

In accordance with an additional aspect of the invention disclosed herein, a watercraft comprises a hull. The hull supports an engine and the engine comprises a throttle. The watercraft further comprises a means for selecting between at least a first and second resting position for the throttle. The second resting position provides a larger opening degree than the first throttle position. A throttle actuator mechanism is coupled to the throttle to move the throttle from either the first or second resting positions toward a wide open position.

An additional aspect of the present invention involves a method of control an engine speed of a marine engine that powers a propulsion unit of a watercraft. The method comprises selecting between a high idle speed and a low idle speed depending upon the particular environment in which the watercraft is operated, and adjusting the engine idle speed in accordance with the selection. Such selection can be done either manually or automatically and the mechanism to accomplish the adjustment to engine idle speed can work together with or apart from a primarily throttle actuator mechanism.

For purposes of summarizing the invention, certain aspects, advantages and novel features of the invention have been described herein above. Of course, it is to be understood that not necessarily all advantages disclosed or taught herein may be achieved in accordance with any particular embodiment of the invention. Thus, the invention may be embodied or carried out in a manner that achieves or optimizes one advantage or group of advantages as disclosed or taught herein without necessarily achieving other advantages as may be disclosed, taught or suggested herein.

BRIEF DESCRIPTION OF THE DRAWINGS

The above-mentioned and other features of the invention will now be described with reference to the drawings of the embodiments of the present operational control device in the context of a personal watercraft. The illustrated embodiments of the operation control device are intended to illustrate, but not to limit, the invention. The drawings contain the following FIGS. 1–6.

DETAILED DESCRIPTION OF THE EMBODIMENTS

Figure 1:
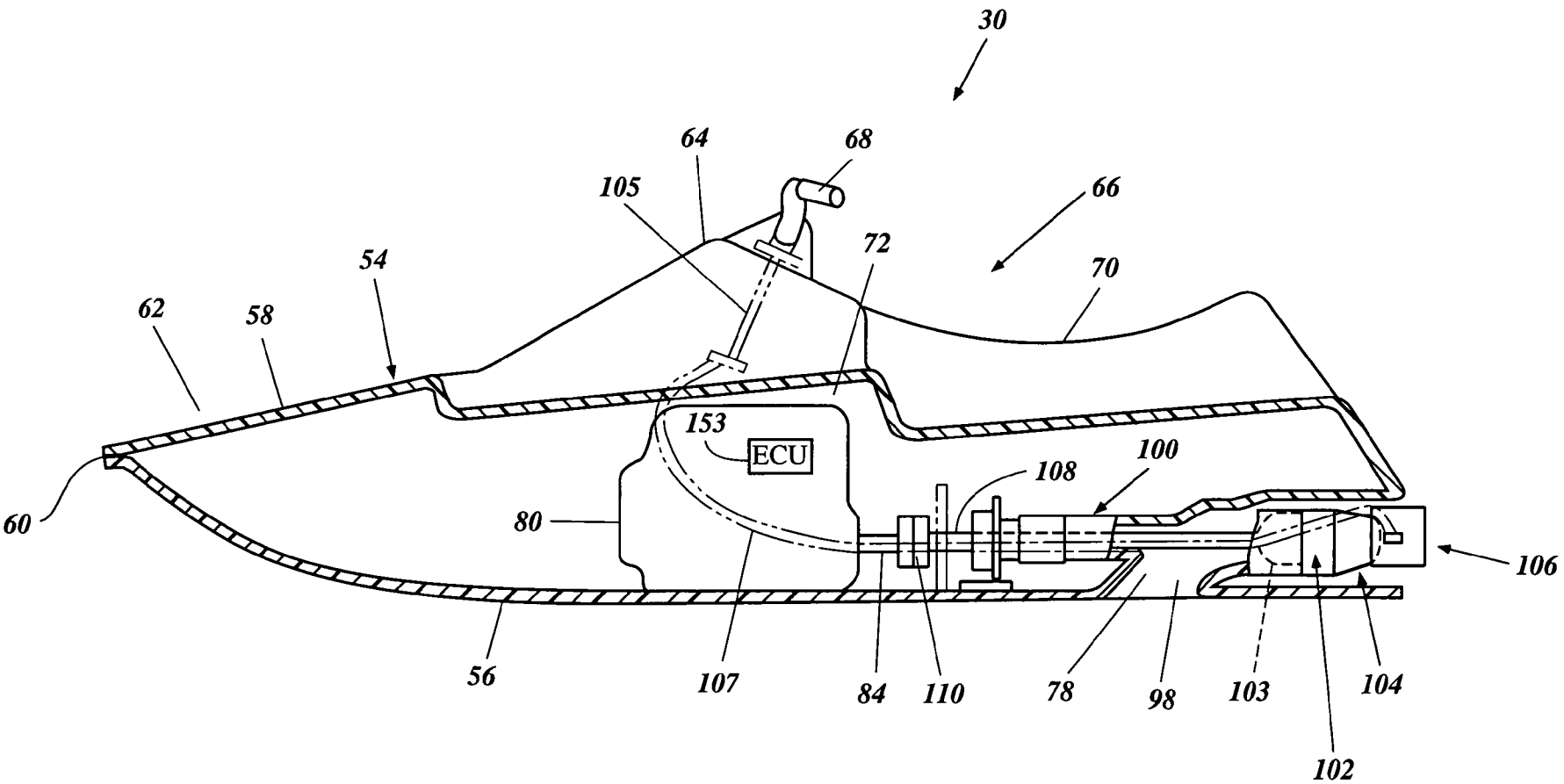
FIG. 1 is a side elevational and partial cut-away view of a small watercraft, having a jet propulsion unit including a reverse thrust system configured in accordance with an embodiment of the present invention, and shows several internal components of the watercraft, including a jet propulsion unit and engine.

FIG. 1 illustrates a personal watercraft 30 that includes a throttle operation control device 40 (FIG. 2) and a reverse thrust arrangement 52 (FIG. 3) configured in accordance with an embodiment of the present invention. Although the present throttle operation control device 40 and reverse thrust arrangement 52 are illustrated in connection with a personal watercraft, the throttle operation control device 40 and the reverse thrust arrangement 52 can be used with other types of watercraft as well, such as, for example, but without limitation, small jet boats and the like. Initially, an exemplary personal watercraft 30 is described below in general detail to assist the reader's understanding of the environment of use and the operation of the throttle operation control device 40 and the reverse thrust arrangement 52.

With reference to FIG. 1, the small watercraft 30 includes a hull 54 formed by a lower hull section 56 in an upper deck section 58. The hull sections 56, 58 are formed from a suitable material such as, for example, a molded fiberglass reinforced resin or sheet molding compound. The lower hull section 56 and the upper deck section 58 are affixed to each other around the peripheral edges 60 in a convenient manner.

As viewed in the direction from the bow to the stern of the watercraft 30, the upper deck section 58 includes a bow portion 62, a control mast 64, and a rider's area 66. The control mast 64 extends upward from the bow portion 62 and supports a handlebar assembly 68. The handlebar 68 controls the steering of the watercraft 30. The handlebar assembly 68 also carries a variety of controls of the watercraft 30, such as, for example, a throttle control, a start switch, and additional controls described in more detail below.

The rider's area 66 lies behind the control mast 64 and includes a seat assembly 70. In the illustrated embodiment, the seat assembly 70 has a longitudinally extending straddle-type shape that may be straddled by an operator and by one or more passengers. A pair of foot areas (not shown) can extend generally longitudinally and parallel to the sides of the seat assembly 70. The lower hull portion 56 cooperates with the upper deck portion 58 to define an engine compartment 72 of the watercraft 30. The watercraft 30 can include air ducts (not shown). Except for the included air ducts, the engine compartment 72 is normally substantially sealed so as to enclose an engine of the watercraft 30 from the body of water in which in the watercraft is operated.

The lower hull 56 is designed such that the watercraft 30 planes or rides on a minimum surface area at the aft end of the lower hull 56 in order to optimize the speed and handling of the watercraft 30 when up on plane. For this purpose, the lower hull section 56 generally has a V-shaped configuration formed by a pair of inclined sections that extend outwardly from a keel line of the hull to the hull's side walls at dead-rise angle.

The inclined sections also extend longitudinally from the bow toward the transom of the lower hull 56. The side walls are generally flat and straight near the stern of the lower hull 56 and smoothly blend toward the longitudinal center of the watercraft 30 at the bow 62. The lines of intersection between each inclined section and the corresponding sidewall form the outer chines of the lower hull 56.

Near the transom of the watercraft 30, the inclined sections of the lower hull 56 extend outwardly from a recessed channel, or tunnel 78, that extends upward toward the upper deck portion 58. The tunnel 78 has a generally parallelpiped shape and opens through the rear of the transom of the watercraft 30.

An internal combustion engine 80 powers the watercraft 30. The engine 80 is positioned within the engine compartment 72 and is mounted in the illustrated embodiment generally beneath the control mast 64, although in other embodiments the engine can be mounted either fore or aft relative to the illustrated position. Vibration absorbing engine mounts can secure the engine 80 to the lower hull portion 56 in a known manner. For example, the engine mounts can be supported by a liner (not shown) disposed in the engine compartment 72. The engine 80 in the illustrated embodiment is mounted in approximately a central position of the watercraft 30.

A fuel tank (not shown) is disposed within the engine compartment 72 and stores fuel for the engine 80. The fuel tank can be positioned on a forward side of the engine 80.

A cylinder block and cylinder head assembly desirably form the cylinders of the engine 80. A piston reciprocates within each cylinder of the engine 80. The pistons drive an output shaft 84 as the reciprocate. A connecting rod links the corresponding piston to a crankshaft of the engine 80, which is drivingly connected to the output shaft. The corresponding cylinder bore, piston and cylinder head of each cylinder forms a variable volume chamber, which at a minimum volume defines a combustion chamber.

The crankshaft desirably is journaled within a crankcase that, in one embodiment, is formed between a crankcase member and a lower end of the cylinder block. Where the engine 80 is a two-stroke engine, individual crankcase chambers of the engine 80 are formed within the crankcase by dividing walls and sealing disks, and are sealed from one another with each crankcase chamber communicating with a dedicated variable volume chamber.

The engine 80 includes an air induction system to provide air to the combustion chambers of the engine 80. An intake silencer (not shown) is connected to a plenum chamber (not shown) through a conduit. The plenum chamber communicates with the combustion chambers through at least one intake passage 86. Desirably, each combustion chamber of the engine communicates with the plenum chamber through a dedicated intake passage 86.

The engine 80 also includes a power request system for allowing an operator to input a power request. The power request system receives the request and controls the engine to provide a power output based on the request. For example, the induction system can include a system for controlling an amount of air flowing into the engine 80. One example of the power request system is a throttle actuator mechanism. The throttle actuator mechanism can include, but is not limited to an operator power request device, an engine throttling device, and a communication between the operator power request device and the engine throttling device. Examples of embodiments of the various parts that make up the throttle actuator mechanism will be explained below in greater detail.

Many known systems exist for controlling the amount of induction air flowing into an engine. For example, the induction system can include a throttle body assembly 88 having a throttle valve 90 configured to control or "meter" an amount of air flowing through the induction system into the engine 80. Different types of throttling mechanisms are possible such as, but not limited to a butterfly valve, a knife valve, or a sliding valve, etc. Where the engine 80 operates on a four-stroke principle, the engine 80 can include variable intake valve timing and/or duration. Such valves can work in cooperation with a throttle body assembly to control an amount of air flowing into the engine. Alternatively, such a valve system can be configured to control the air amount without a throttle body. Such systems can receive a power request input from the operator through direct mechanical connection or through electronic communication. The throttling mechanism can be controlled by an electric motor either through a direct connection or through a remote connection. For example. FIG. 2*b* illustrates an electric motor M that controls the throttle body assembly 88 through a direct connection 89. One embodiment of an operation of the throttle body 88 will be explained in greater detail below.

The engine 80 also includes an exhaust system to transfer exhaust gases from the combustion chambers to a location outside of the engine compartment 72. The exhaust gases can be discharged into or just above the body of water in which the watercraft 30 is operating. An exhaust passage (not shown) communicates with each combustion chamber and extends toward a rearward end of the watercraft 30 and terminates in a water trap (not shown). An exhaust pipe (not shown) extends from the water trap and can open into a jet propulsion unit 100 of the watercraft 30. The water trap inhibits water from moving upstream from the exhaust pipe to the exhaust passage and, thus, inhibits water from entering the combustion chambers of the engine 80.

Those skilled in the art will readily appreciate that the present reverse thrust system and the throttle control system can be used with any of a variety of engine types, such as those that operate on two-cycle, four-cycle, diesel or rotary combustion principles, as well as electric motors, etc. Additionally, the engines may have varying number of cylinders and varying cylinder arrangements, such as, for example, an inline, opposing, V-type or W-type arrangement.

A charge former (e.g., a carburetor or a fuel injector) of the induction system communicates with an inlet end of the intake passage. The charge former receives fuel from the fuel tank and produces the fuel charge which is delivered to the cylinders in a known manner. Alternatively, fuel can be supplied directly into the combustion chamber rather than through the induction system. Because additional internal details of the engine 80 and the induction and exhaust systems desirably are conventional, a further description of the engine construction is not believed necessary to understand and practice the embodiments of the present invention.

The jet propulsion unit 100 propels the watercraft 30. The jet propulsion unit 100 is disposed within the tunnel 78 formed on the underside of the lower hull section 56. An intake duct 98 of the jet propulsion unit 100 defines an inlet opening that permits water to enter the jet propulsion unit 100. The inlet opening opens into a gullet that leads to an impeller housing assembly 102 in which an impeller 103 of the jet propulsion unit 100 rotates.

The impeller housing assembly 102 also acts a pressurization chamber and delivers a water flow to a discharge nozzle 104. A steering nozzle 106 in the illustrated embodiment is supported by bolts 109 (FIG. 3) at the downstream end of the discharge nozzle 104 for rotation about a generally vertical axis.

In an exemplary embodiment, the steering nozzle 106 surrounds the discharge nozzle 104. The steering nozzle 106 is coupled to a handlebar shaft 105, through, for example, a bowden-wire actuator 107, which has a well known construction in the art. In this manner, the operator of the watercraft 30 can move the steering nozzle 106 to effect directional changes of the watercraft 30.

An impeller shaft 108 supports the impeller within the impeller housing assembly 102 of the jet propulsion unit 100. The impeller shaft 108 extends in a forward direction through a front wall of the tunnel 78. The front end of the impeller shaft 108 is coupled to the output shaft 84 of the engine 80 through a coupling 110. In this manner, the engine 80 drives the propulsion unit 100. It is to be noted that the impeller shaft 108 can be formed with a single shaft, or from a plurality of shafts rotatably connected together.

The watercraft 30 can operate in various modes. For example, when the watercraft is operating at a low speed, the watercraft assumes a displacement operational mode where the lower hull section 56 plows through water displacing the water to either side of the lower hull section 56. A planing mode is when the watercraft is traveling at sufficiently high speeds, it glides or planes over top of the body of water. The reduction in surface area of the lower hull section 56 touching the water during the planing mode allows the watercraft to travel at an increased speed. A transition mode occurs when the watercraft transitions between the displacement mode and the planing mode during acceleration or deceleration.

Figure 2:
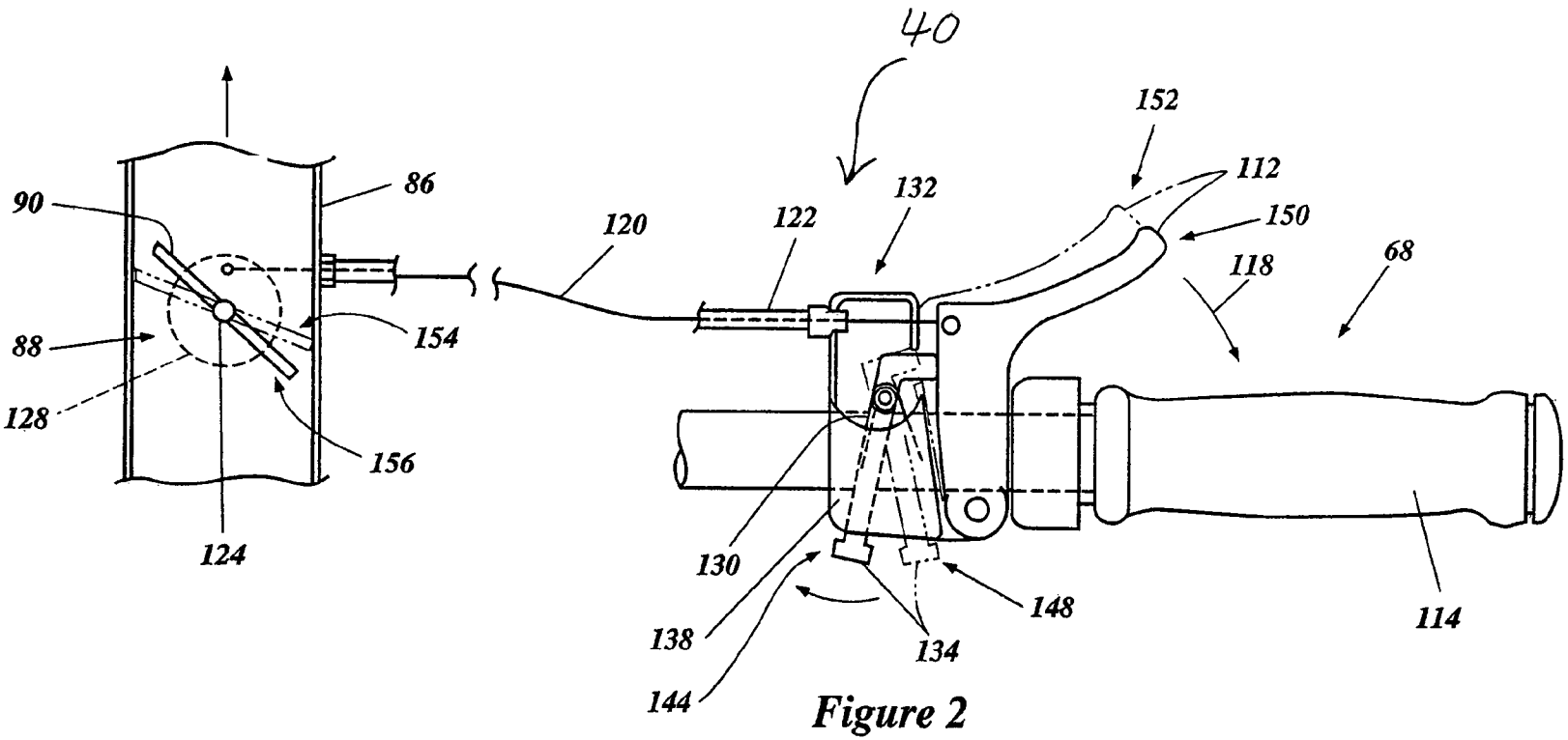
FIG. 2 is a schematic illustration of the operational control device that includes a control lever, a housing comprising a locking position mechanism for the control lever, a throttle actuator mechanism, and a throttle valve.

As illustrated in FIG. 2, a throttle lever 112 can be disposed on the right-hand side of the handlebar assembly 68 adjacent to a handgrip 114 and is actuated by the right-hand of an operator of the watercraft 30. The throttle lever 112 actuates a speed control of the engine 80 through controlling an amount of air and/or and amount of fuel delivered to the engine. In an embodiment of the present invention the throttle lever 112 is moved in a direction illustrated by an arrow 118. The movement of the throttle lever 112 moves a throttle cable 120 positioned inside a protective sheathing 122 that transfers the motion of the throttle lever 112 to the throttle valve 90. As illustrated in FIG. 2, a rotational movement of a throttle valve shaft 124 rotates the throttle valve 90 axially between an open position and a closed position. The throttle cable 120 advantageously transfers motion to the throttle valve shaft 124 allowing the throttle valve 90 to open proportionally to the motion of the throttle lever 112. The throttle cable 120 rotated the throttle valve shaft 124 through a disk 128 against the force of a spring 130. The spring 130 assures that the throttle valve shaft 124 and therefore the throttle valve 90 will return to a resting position when the operator releases the throttle lever 112.

An operational control device 132 including a control lever 134 is located adjacent to the throttle lever 112 and can control the resting position of the throttle lever 112 and therefore the idling speed of the engine 80. The control lever 134 can have multiple positions, for example, at least two positions: a low engine idle position and a high idle position. The control lever thus establishes two different idle speeds for the engine 80. A predetermined lower engine idle speed allows the operator of the watercraft 30 to maneuver the watercraft in environments where slower movement is desired, such as when approaching a dock or a beach.

A predetermined higher engine idle speed produces more water flow through the discharge nozzle 104, hence producing more thrust, to assist turning the watercraft 30 more sharply than the watercraft would turn under the thrust produced at the predetermined lower engine idle speed.

Figure 2A:
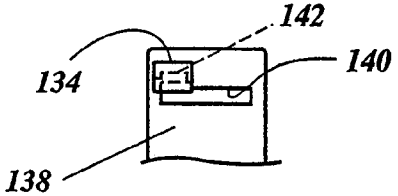
FIG. 2*a* is a side view of the housing illustrating the locking position mechanism for the control lever.
Figure 2B:
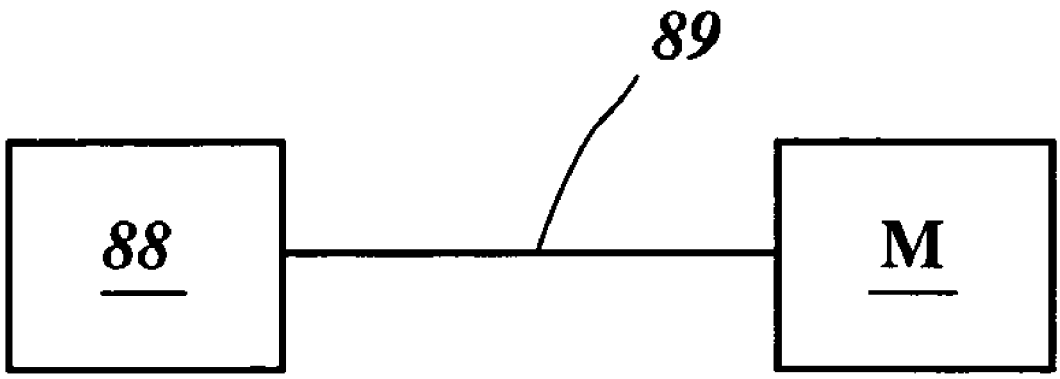
FIG. 2*b* is a schematic view of an electric motor that controls a throttling mechanism through a direct connection.

The operational control mechanism 132 comprises the control lever 134, the spring 130, and a housing 138. The housing 138 allows the control lever to move through a predetermined motion within a slot 140 (FIG. 2*a*). At one end of the slot 140 there is a locking recess 142 that locks the control lever 134 in a high engine idle speed position 144. When the operator chooses to manually move the control lever 134 to a low engine idle speed position 148, the control lever 134 can be moved from the locking recess 142 to the control lever low engine idle speed position 148 under the bias of the throttle actuator mechanism. The throttle lever 112 holds the control lever 134 in the low engine idle speed position 148 until the throttle lever 112 is moved above a high engine idle speed position 150. When the throttle 112 is moved above the high engine idle speed position 150, the control lever 134 can be moved under the force of the spring 130 into the locking recess 142, i.e. the control lever 134 is persuaded by the spring 130 to move to the high engine idle speed position 144.

When the control lever 134 is in the low engine speed position 148, the control lever 134 allows the throttle lever 112 to rest at a low idle engine speed position 152, which therefore allows the throttle valve 90 to rest at a predetermined low engine idle speed position 154.

When the control lever 134 is in the high engine idle speed position 144 the control lever 134 allows the throttle lever 112 to rest at the high idle engine speed position 150, which therefore allows the throttle valve 90 to rest at a predetermined high engine idle speed position 156.

In another embodiment, the control lever 134 can mechanically actuate a device or mechanism that either increases or decreases engine speed independently of the throttle lever 112, by varying the amount of air inducted, the amount of fuel supplied and/or ignition timing. For example, the control lever 134 can actuate an auxiliary air bypass valve independently of the throttle valve 112 to allow more or less air into the engine depending on which engine idle speed is desired by the operator. Alternatively, the control lever 134 can operate the throttle valve independently of the throttle lever by cooperating with another component of the throttle actuator mechanism or with another actuator mechanism coupled to the throttle valve in parallel with the primary throttle actuator system.

The engine idle speed can also be controlled by an electronic control unit 153 (e.g. ECU). Various sensors such as, but not limited to, a throttle position sensor, an engine speed sensor, an engine temperature sensor, an intake air mass sensor, etc., can communicate with the ECU 153 to allow the ECU 153 to accurately control the engine speed. The operator can activate an idle speed switch that can signal to the ECU 153 which idle speed the operator desires. The switch can be multi-positioned or variably adjustable by the operator. The ECU 153 can then control the engine depending on which engine idle speed is desired by the operator. The engine speed control by the ECU 153 can be accomplished many known ways including, but not limited to controlling the throttle actuator, an auxiliary air bypass valve, fuel injection amount and timing, ignition timing, camshaft timing adjustment and combinations thereof. One advantage of using the ECU 153 to control the throttle actuator, the auxiliary air bypass valve, fuel injection amount and timing, and camshaft timing adjustment is that the ECU 153 can also control the engine speed during a shifting operation.

The above-described operational control device 132 can allow the operator to easily choose manually between a low engine idle speed, which allows for slow-speed maneuverability around docks and near beaches, and a high idle engine speed, which allows for tighter turning when the throttle lever is released in comparison to the turning radius available at a lower engine idle speed. The ECU 153 can also control the engine idle speed through, for example, but not limited to an auxiliary air bypass valve such as the type disclosed above. Additionally the auxiliary air bypass system can also be used separately from the manually operated control mechanism 132.

In the embodiment, during a shifting operation, the ECU 153 can lower the engine idle speed to allow the operator to comfortably operate the watercraft 30 between a neutral and forward or a neutral and reverse operation. When the operator has finished performing a shifting operation, the ECU 153 can raise the engine idle to increase idling thrust. A throttle position sensor (not shown) allows the ECU to determine the position of the throttle and therefore the position of the control lever 134.

Figure 3:
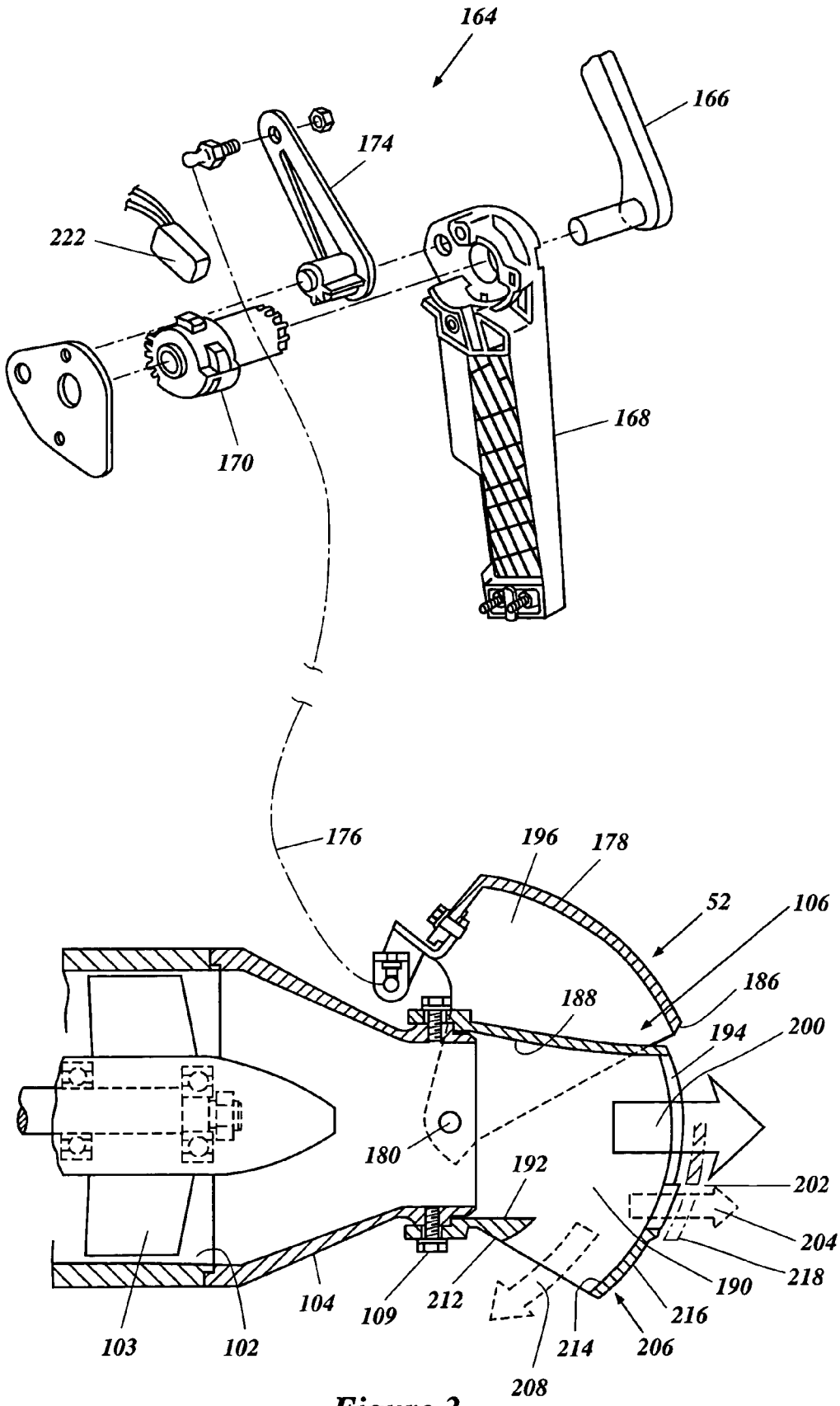
FIG. 3 is a partial schematic view of a control system of the reverse thrust system that is operable to move a water diverter bucket assembly between an upper position, a middle position, and a lower position. The control assembly includes a control handle mechanism.

With reference to FIG. 3, the reverse thrust arrangement 52 and a reverse thrust control mechanism 164 are shown. A reverse thrust control lever 166 rotates within a support piece 168 and is fastened to a transmission shaft 170. When the reverse thrust control lever 166 is rotated, the transmission shaft 170 communicates the rotational force to an actuation lever 174. The actuation lever 174 communicates the force originating from the reverse thrust control lever 166 through, for example, a reverse thrust bowden-wire actuator 176, as is known in the art. The reverse thrust bowden wire actuator 176 moves with a water diverter bucket assembly, or thrust bucket 178.

In the illustrated embodiment, the water diverter bucket or thrust bucket 178 is pivotally supported on a pair of pins 180 adjacent the steering nozzle 106 of the jet propulsion unit 100. The thrust bucket 178 is movable between an open position, wherein the thrust bucket 178 does not substantially interfere with a water jet issuing from the steering nozzle 106, to a fully closed position, wherein the thrust bucket 178 can redirect at least a portion of the water jet issuing from the steering nozzle 106 in a generally forward direction to produce a reverse thrust.

In the illustrated embodiment, the thrust bucket 178 comprises a single member which is pivotal about a horizontal axis to move from a raised position to a lowered position. However, other reverse thrust bucket arrangement are also possible, such as a pair of thrust bucket members supported on each side of the steering nozzle 106 mounted to pivot about a vertical axis from an open position to a closed position.

In the illustrated embodiment, the thrust bucket 178 is hinged to the steering nozzle 106 through the pins 180 allowing the thrust bucket 178 to move in an upward/downward rotating motion. The steering nozzle 106 in the illustrated embodiment includes two discharge paths: through a steering nozzle opening 194 and through a reverse nozzle 206. The steering nozzle opening 194 can be located directly behind the effluent opening of the discharge nozzle 104, i.e., the opening 194 generally is concentrically positioned about a flow axis through the discharge nozzle 104. The reverse nozzle 206 can be positioned next to and generally in front of the steering nozzle opening 194 and, in the illustrated embodiment, is disposed on the lower side of the steering nozzle 106. The reverse nozzle 206 in the illustrated embodiment has a smaller cross-sectional flow area size than that of the steering nozzle opening 194.

The various upward/downward positions of the thrust bucket 178 diverge at least some water to flow in a rearward direction, a forward direction, or a combination of directions. Depending on the position of the thrust bucket 178 the water flow travels through a steering nozzle opening 194, a reverse nozzle 206, or a combination of both outlets 194, 206. The various positions of the thrust bucket 178 and the direction of water flow will be described in greater detail below.

Figure 4A:
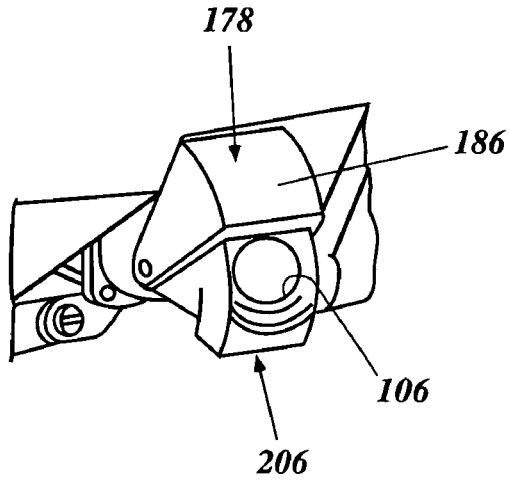
FIG. 4*a* is a view of the reverse thrust system in an upper position such that the jet propulsion unit discharges water in a rearward direction to propel the watercraft forward.

With reference to FIGS. 3 and 4*a*, the thrust bucket 178 can be in an uppermost position 186 above the steering nozzle 106. An upper surface 188, side surfaces 190, and a lower surface 192 together form an inner passageway that guides the water flow through the steering nozzle opening 194 of the steering nozzle 106. When the thrust bucket 178 is in the uppermost position 186 above the steering nozzle 106, at least a substantial portion of the water exiting from the steering nozzle 106 flows in a rearward direction 200, thereby propelling the watercraft 30 in a forward direction.

Figure 4B:
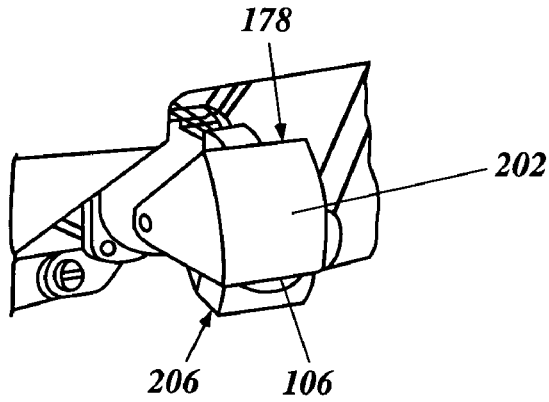
FIG. 4*b* is a view of the reverse thrust arrangement in a middle or neutral position such that the jet propulsion unit discharges water simultaneously in a rearward direction and in a forward direction, thereby allowing the watercraft to remain generally in a stationary position.

As shown in FIGS. 3 and 4*b*, the thrust bucket 178 can be moved into a middle or "neutral" position 202 that partially covers the steering nozzle opening 194 of the steering nozzle 106. When the thrust bucket 178 is in the neutral position 202, a portion of the water is propelled from the steering nozzle 106 in a rearward direction 204 and a portion of the water is diverted by a thrust bucket inner surface 196 and flows through the reverse nozzle 206 of the steering nozzle 106. The water flowing through the reverse nozzle 206 flows in a forward direction 208. A guide portion 212 and an inner nozzle surface 214 of a guide portion 216 guide the water flow in the forward direction 204. As a result of the generally balanced thrusts in opposite directions (forward and reverse), the watercraft 30 remains generally stationary on the water when the thrust bucket 178 is in the position 202 that partially covers the steering nozzle 106.

Figure 4C:
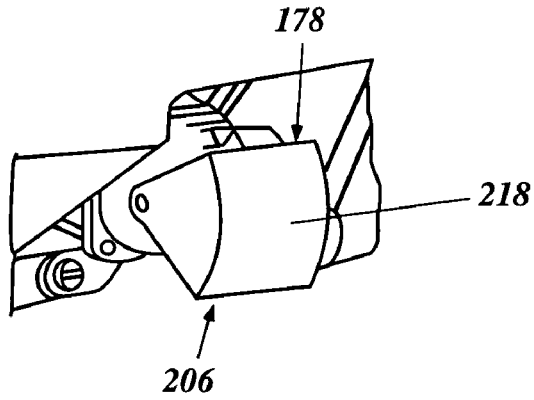
FIG. 4*c* is a view of the reverse thrust arrangement in a lower position such that the jet propulsion unit discharges water in a forward direction to propel the watercraft rearward.

As shown in FIGS. 3 and 4*c*, the thrust bucket 178 can be moved into a position 218 that completely covers the steering nozzle 106. When the thrust bucket 178 is in the position 218 that completely covers the steering nozzle 106, substantially all the water exiting from the discharge nozzle 104 can flow through the reverse nozzle 206 in the forward direction 208 thereby propelling the watercraft 30 in a rearward direction.

Therefore, the thrust bucket 178 can be in the position above the steering nozzle 104 to propel the watercraft 30 forward (a forward position). The thrust bucket 178 can also be in a position that partially covers the discharge nozzle 104 (a neutral position) and another thrust bucket position completely covers the discharge nozzle 104 to propel the watercraft 30 rearward (a reverse position). The operator of the watercraft 30 can move the reverse thrust control lever 166 to effect the forward and reverse directions of the watercraft 30 as well as to effect a neutral operating condition.

The position of the transmission shaft 170 and therefore the position of the reverse thrust control lever 166 can be monitored by a neutral switch 222. The neutral switch 222 determines when the transmission shaft 170 and therefore the thrust bucket 178 is in the neutral position 202. The neutral switch 222 can relay to the ECU 153 if the thrust bucket 178 is in the neutral position 202, or the neutral switch 222 can directly interrupt the electrical connection between a start switch (not shown) and a starter (not shown). In the illustrated embodiment, the operator therefore cannot start the engine 80 unless the thrust bucket 178 is in the neutral position 202. The neutral switch 222 can be a micro switch or any variety of switch as known by someone familiar in the art. The neutral switch 222 can positioned in different locations and detect the position of various other components besides the position of the transmission shaft to determined when the thrust bucket 178 is in the neutral position.

The thrust bucket position can also be established by the ECU 153 through an actuator (not shown) depending on a position of a watercraft direction switch (not shown). For example, the operator can move the switch between forward, neutral, and reverse positions and the ECU 153 can signal the actuator to move the thrust bucket 178 into one of its positions that corresponds to the selected switch position.

Figure 5:
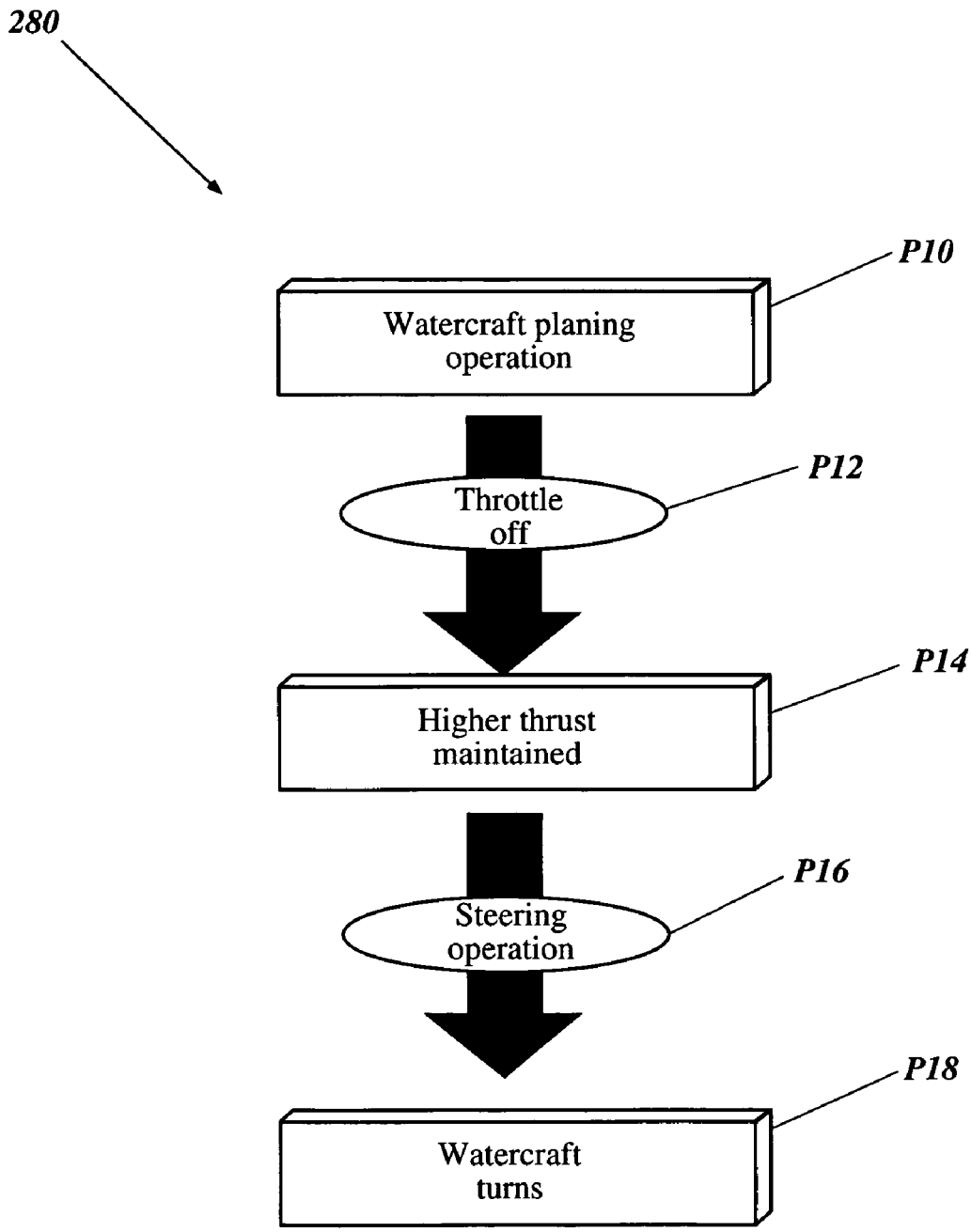
FIG. 5 is a block diagram showing a control routine arranged and configured in accordance with certain features, aspects, and advantages of the present invention.

With reference to FIG. 5, a control routine 280 is shown that is arranged and configured in accordance with certain features, aspects, and advantages of the present invention. The control routine 280 illustrates an example of watercraft idle speed control.

The control routine 280 begins at an operation block P10. In operation block P10, the watercraft is operating in a planing mode. The control routine 280 then moves to an operation block P12.

In operation block P12, the operator of the watercraft releases the throttle lever i.e., the throttle closes. The control routine 280 then moves to an operation block P14.

In operation block P14, the control routine 280 maintains a sufficient thrust level to allow for tighter turning of the watercraft than at lower thrust levels. The control routine 280 then proceeds to an operation block P16.

In operation block P16, the operator of the watercraft steers the watercraft. The control routine 280 then moves to an operation block P18 where the watercraft maintains a higher thrust than at a lower idle speed.

Figure 6:
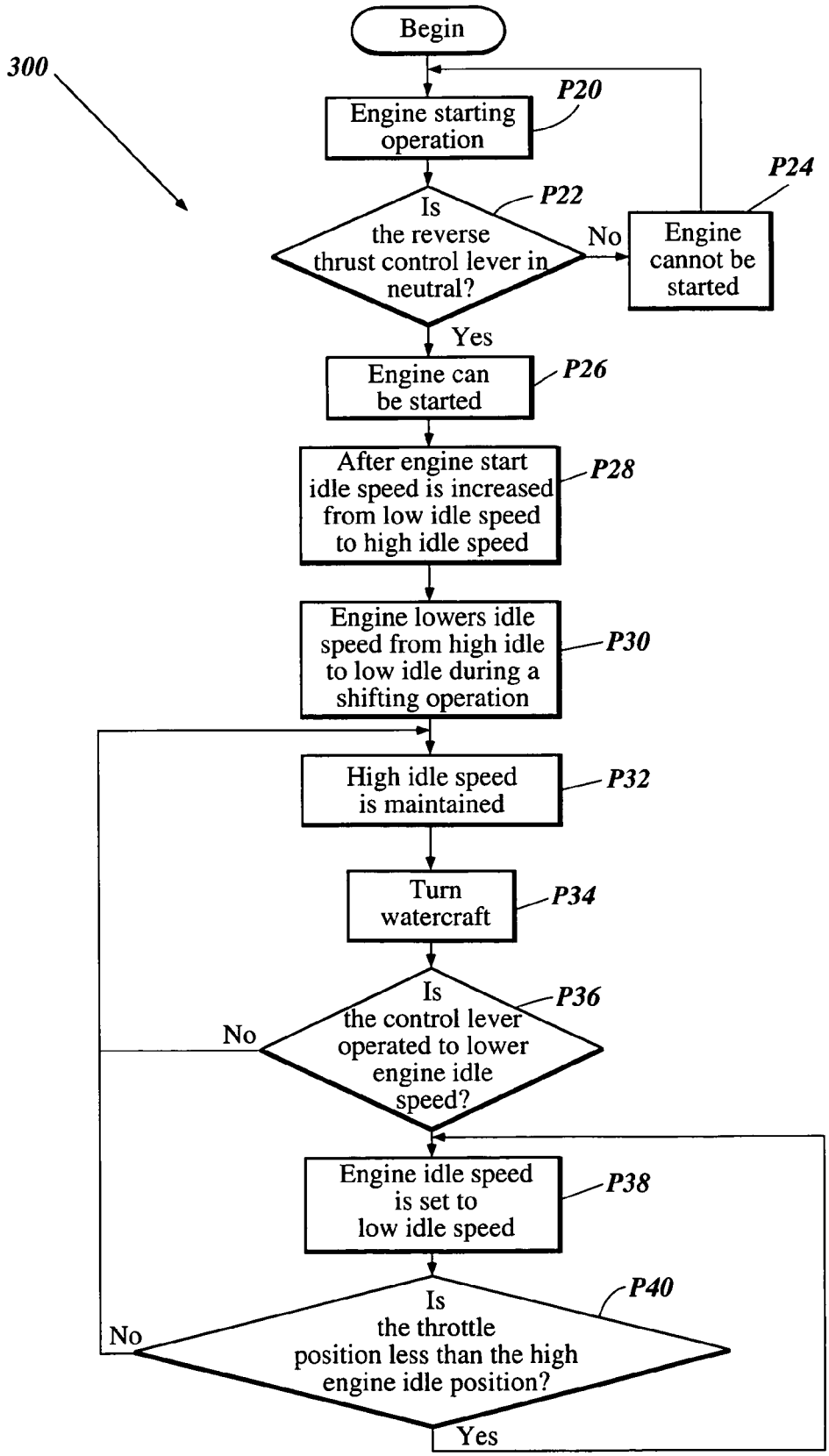
FIG. 6 is a block diagram showing another control routine arranged and configured in accordance with certain features, aspects, and advantages of the present invention.

With reference to FIG. 6, another control routine 300 is shown that is arranged and configured in accordance with certain features, aspects and advantages of another embodiment of the present invention. The control routine 300 begins and moves to an operation block P20, where an engine starting operation commences. An engine starting operation can be defined as the operator activating a starter button or switch. The control routine 300 then moves to a decision block P22.

In decision block P22, it is determined if the reverse thrust control lever is in a neutral position. In decision block P22, if it is determined that the reverse thrust control lever is not in a neutral position, the control routine. 300 moves to an operation block P24 where the ECU does not allow the engine to be started. In two exemplary embodiments, the neutral switch 222 can relay to the ECU if the thrust bucket is in the neutral position, or the neutral switch 222 can directly interrupt the electrical connection between the start switch and the starter. Therefore, the operator cannot start the engine unless the thrust bucket is in the neutral position. The control routine 300 then returns to the operation block P20.

However, if at decision block P22 it is determined that the reverse control lever is in neutral, the control routine 300 moves to an operation block P26 where the control routine 300 allows the engine to be started. A control routine 300 then moves to an operation block P28.

At operation block P28, after the engine is started, the idle speed can be increased from a low idle speed to a high idle speed according to the manual control of the operator. During starting of the illustrated embodiment of the watercraft, the watercraft does not significantly move when the high engine idle is applied. The control routine 300 then moves to an operation block P30.

At operation block P30, the control routine lowers the engine idle speed from the high idle speed to a low idle speed during a shifting operation. The lower engine speed during shifting allows the operator to shift the thrust bucket smoothly from the neutral position to either the forward position or a reverse position. The control routine 300 then moves to an operation block P32.

At operation block P32, the control routine 300 maintains the high engine idle position once the operator controls the watercraft to exceed the predetermined high idle speed. The high engine idle speed can be maintained through the control lever 134 or by the ECU 153. The high engine idle provides an increased thrust for assisting steering even when the operator has released the throttle lever while decelerating from a planing speed. The control routine 300 then moves to an operation block P34.

In operation block P34, the watercraft turns even though the operator has released the throttle. The control routine 300 then moves to a decision block P36.

In decision block P36, the control routine 300 determines if the control lever 134 is operated manually by the operator to lower the engine idle speed. In decision block P36, if the control lever is not operated manually to lower the engine idle speed, the control routine 300 returns to the operation block P32. If, however, in decision block P36 it is determined that the control lever is operated manually to lower the engine idle speed, the control routine 300 then moves to an operation block P38.

In operation block P38, the engine idle speed is set to the low engine idle speed. The control routine then moves to a decision block P40.

In decision block P40, it is determined if the throttle position is less than the high engine idle throttle position (e.g. by the TPS sensor). If in decision block P40 it is determined that the throttle position is not less than the high engine idle throttle position, the control routine 300 returns to the operation block P32. If, however, in decision block P40, it is determined that the throttle position is less than the high engine idle throttle position, the control routine 300 returns to the operation block P38.

Although this invention has been disclosed in the context of certain embodiments and examples, it will be understood by those skilled in the art that the present invention extends beyond the specifically disclosed embodiments to other alternative embodiments and/or uses of the invention and obvious modifications and equivalents thereof. In particular, while the present watercraft operational control device has been described in the context of particular embodiments, the skilled artisan will appreciate, in view of the present disclosure, that certain advantages, features and aspects of the device may be realized in a variety of other applications, many of which have been noted above. Several aspects of the invention can also be used with steering nozzles and reverse thrust buckets having other configurations than that described above. Additionally, it is contemplated that various aspects and features of the invention described can be practiced separately, combined together, or substituted for one another, and that a variety of combination and subcombinations of the features and aspects can be made and still fall within the scope of the invention. Thus, it is intended that the scope of the present invention herein disclosed should not be limited by the particular disclosed embodiments described above, but should be determined only by a fair reading of the claims.

What is claimed is:

1. A watercraft comprising a hull, an engine being supported by the hull and including at least one throttle, a jet propulsion unit driven by the engine, the jet propulsion unit comprising a steering nozzle configured to direct a jet of water exiting the jet propulsion unit, a throttle actuator mechanism comprising a user-operable lever coupled with the throttle, and a control lever mounted adjacent the user-operable lever and cooperating with the throttle actuator mechanism, the control lever being selectively positioned in at least first and second positions, the control lever being actuatable to assume either of the first and second positions independently of a steering condition of the watercraft, the first position of the control lever being arranged such that the throttle actuator mechanism rests in a first position and the second position of the control lever being arranged such that the throttle actuator mechanism rests in a second position, the throttle having a first position when the throttle actuator mechanism rests in its first position and having a second position when the throttle actuator mechanism rests in the second position, wherein the second throttle position provides a larger opening degree than the first throttle position.

2. The watercraft of claim 1, wherein the engine sufficiently powers the jet propulsion unit when the throttle rests in its second position to assist steering of the watercraft when decelerating from at least a planing speed.

3. The watercraft of claim 1 additionally comprising an operational control device housing supporting the control lever.

4. The watercraft of claim 3, wherein the housing is disposed next to at least a portion of the throttle actuator mechanism.

5. The watercraft of claim 1 additionally comprising a steering device connected to the steering nozzle and configured to be grasped by at least a first hand of an operator, wherein the user-operable lever and the control lever are mounted such that a user can simultaneously operate the user-operable lever, the control lever, an the steering device with the first hand.

6. The watercraft of claim 1, wherein the user-operable lever and the control lever are mounted to pivot about parallel axes.

7. A watercraft comprising a hull, an engine being supported by the hull and including at least one throttle, a jet propulsion unit driven by the engine, the jet propulsion unit comprising a steering nozzle configured to direct a jet of water exiting the jet propulsion unit, a throttle actuator mechanism comprising a user-operable lever coupled with the throttle, and a control lever mounted adjacent the user-operable lever and cooperating with the throttle actuator mechanism, the control lever being selectively positioned in at least first and second positions, the control lever being actuatable to assume either of the first and second positions independently of a steering condition of the watercraft, the first position of the control lever being arranged such that the throttle actuator mechanism rests in a first position and the second position of the control lever being arranged such that the throttle actuator mechanism rests in a second position, the throttle having a first position when the throttle actuator mechanism rests in its first position and having a second position when the throttle actuator mechanism rests in the second position, wherein the second throttle position provides a larger opening degree than the first throttle position, an operational control device housing supporting the control lever, wherein the housing defines a slot having first and second ends, the control lever is arranged so as to slide within the slot, and a biasing mechanism biases the control lever toward the second end of the slot.

8. A watercraft comprising a hull, an engine being supported by the hull and including at least one throttle, a jet propulsion unit driven by the engine, the jet propulsion unit comprising a steering nozzle configured to direct a jet of water exiting the jet propulsion unit, a throttle actuator mechanism coupled with the throttle, a control lever cooperating with the throttle actuator mechanism, and a housing supporting the control lever, the control lever being selectively positioned in at least first and second positions, the first position of the control lever being arranged such that the throttle actuator mechanism rests in a first position and the second position of the control lever being arranged such that the throttle actuator mechanism rests in a second position, the throttle having a first position when the throttle actuator mechanism rests in its first position and having, a second position when the throttle actuator mechanism rests in the second position, wherein the second throttle position provides a larger opening degree than the first throttle position, and wherein the housing defines a locking recess that defines the second position of the control lever.

9. A watercraft comprising a hull, an engine being supported by the hull and including at least one throttle, a jet propulsion unit driven by the engine, the jet propulsion unit comprising a steering nozzle configured to direct a jet of water exiting the jet propulsion unit, a throttle actuator mechanism coupled with the throttle, and a control lever cooperating with the throttle actuator mechanism, the control lever being selectively positioned in at least first and second positions, the first position of the control lever being arranged such that the throttle actuator mechanism rests in a first position and the second position of the control lever being arranged such that the throttle actuator mechanism rests in a second position, the throttle having a first position when the throttle actuator mechanism rests in its first position and having a second position when the throttle actuator mechanism rests in the second position, wherein the second throttle position provides a larger opening degree than the first throttle position, and wherein the throttle actuator mechanism includes a biasing mechanism that biases the throttle actuator mechanism toward its first resting position, and wherein a force of the biasing mechanism, operating on the throttle lever is greater than a force of the biasing mechanism operating on the control lever.

10. A watercraft comprising a hull, an engine being supported by the hull and including at least one throttle, a jet propulsion unit driven by the engine, the jet propulsion unit comprising a steering nozzle configured to direct a jet of water exiting the jet propulsion unit, a throttle actuator mechanism comprising a user-operable lever coupled with the throttle, and a control lever mounted adjacent the user-operable lever and cooperating with the throttle actuator mechanism, the control lever being selectively positioned in at least first and second positions, the control lever being actuatable to assume either of the first and second positions independently of a steering condition of the watercraft, the first position of the control lever being arranged such that the throttle actuator mechanism rests in a first position and the second position of the control lever being arranged such that the throttle actuator mechanism rests in a second position, the throttle having a first position when the throttle actuator mechanism rests in its first position and having a second position when the throttle actuator mechanism rests in the second position, wherein the second throttle position provides a larger opening degree than the first throttle position, wherein the throttle actuator mechanism comprises a throttle lever disposed remotely from the engine and a throttle actuation mechanism directly connected to the throttle.

11. The watercraft of claim 10, wherein the throttle actuator mechanism additionally comprises a control cable extending between the throttle lever and the throttle actuation mechanism.

12. The watercraft of claim 10, wherein the throttle actuation mechanism includes an electric motor.

* * * * *